US005535837A

United States Patent [19]

Carlin

[11] Patent Number: 5,535,837

[45] Date of Patent: Jul. 16, 1996

[54] HELICAL STRESS RELIEF GROOVE APPARATUS AND METHOD FOR SUBTERRANEAN WELL DRILL PIPE ASSEMBLIES

[75] Inventor: Frank J. Carlin, Houston, Tex.

[73] Assignee: Grant Prideco, Inc., Houston, Tex.

[21] Appl. No.: 270,247

[22] Filed: Jul. 5, 1994

[51] Int. Cl.[6] ..... E21B 17/22; F16L 15/00

[52] U.S. Cl. ..... 175/323; 285/333

[58] Field of Search ..... 175/320, 323, 175/423; 285/114, 333; 464/183

[56] References Cited

U.S. PATENT DOCUMENTS

| | | | |
|---|---|---|---|
| 2,205,697 | 6/1940 | Scharpenberg | 285/333 X |
| 2,676,820 | 4/1954 | Boice . | |
| 3,125,173 | 3/1964 | Fox | 175/323 |
| 3,554,307 | 1/1971 | Yount . | |
| 3,666,022 | 5/1972 | Bailey et al. . | |
| 3,730,286 | 1/1973 | Weiner . | |
| 4,076,436 | 2/1978 | Slater et al. | 285/333 X |
| 4,460,202 | 7/1984 | Chance et al. | 285/333 |
| 4,811,800 | 3/1989 | Hill et al. . | |
| 4,892,337 | 1/1990 | Gunderson et al. | 285/333 |
| 5,040,622 | 8/1991 | Winship et al. . | |
| 5,286,069 | 2/1994 | Wilson | 285/333 X |
| 5,355,968 | 10/1994 | Smith | 175/320 |
| 5,358,285 | 10/1994 | Wilson | 285/333 X |

*Primary Examiner*—Frank S. Tsay
*Attorney, Agent, or Firm*—Beirne, Maynard & Parsons

[57] ABSTRACT

An apparatus and method are provided for enhancing fatigue and stress resistance properties of a subterranean well drill pipe string section by providing a helical groove near the pipe to tool joint weld. Stresses in and around the top portion of the pipe are redistributed to and absorbed by the helical groove region of the drill pipe string section, which has a relatively greater resistance to fatigue caused by bending and other stresses, thereby making the drill pipe string section less prone to fail due to rotational, tensile, and bending stresses.

12 Claims, 1 Drawing Sheet

HELICAL STRESS RELIEF GROOVE APPARATUS AND METHOD FOR SUBTERRANEAN WELL DRILL PIPE ASSEMBLIES

BACKGROUND OF THE INVENTION

1. Field of the Invention

The invention relates to drill pipe for subterranean wells, and the like, having tool joints secured to well drill pipe sections.

2. Brief Description of the Prior Art

Drill pipe strings, which comprise multiple drill pipe string sections threadably connectable to one another, are used to drill subterranean wells. Drill pipe string sections comprise tool joints and drill pipe sections, typically welded to each other. When drill pipe is used to drill subterranean wells, the drill pipe sections are exposed to bending, torsional, and other stresses. Such stresses are primarily due to hole curvatures extending through the entire length of the drilled hole and to the rotating motion of the drill pipe string. Such stresses may cause fatigue of the drill pipe sections due to fluctuating reversed bending stress which is imposed during rotation of the drill pipe string. During these fluctuating reversed bending stresses, this portion of the pipe is alternately subjected to pressure, tensile, and twisting or torsional forces as the drill pipe rotates. If the drill pipe falls by such resulting fatigue, the location of the fatigue point is oftentimes approximate the area of securement thereof to the tool joint, i.e., from about 1 to about 5 feet from the point of securement of the top end of the pipe to the tool joint. The stress in this portion of the drill pipe is usually considerably higher than the stress that is imposed on the remaining portions of the drill pipe string section.

If pipe fails by fatigue, the fatigue often originates in a slip mark. Slip marks occur at the end of the drill pipe attached to the tool joint, because rotatory slips are used to support the drill pipe string during the make and break cycles while drilling and tripping out of a well hole occur. These slips act as wedges that hold the entire weight of the drill pipe string. The portion of the slips that touch the pipe have teeth that can dig into or notch the pipe sections. These notches can act as stress risers that can act as a site for premature fatigue crack initiation and propagation. The above-mentioned bending stresses can initiate these fatigue cracks, thus causing the pipe to fail.

Applicant is aware of the following prior art which is addressed to similar problems of stress on subterranean well drill pipe string sections, but which does not anticipate or render obvious the present invention: (1) U.S. Pat. No. 2,676,820, issued Apr. 27, 1954, and entitled "Drill Collar"; (2) U.S. Pat. No. 3,554,307, issued Jan. 12, 1971, and entitled "Turbulent Flow Drill Collar"; (3) U.S. Pat. No. 3,666,022, issued May 30, 1972, and entitled "Striking Bar"; (4) U.S. Pat. No. 3,730,286, issued May 1, 1973, and entitled "Apparatus for Improving Rotary Drilling Operations"; (5) U.S. Pat. No. 4,811,800, issued Mar. 14, 1989, and entitled "Flexible Drill String Member Especially for Use in Directional Drilling"; and (6) U.S. Pat. No. 5,040,622, issued Aug. 20, 1991, and entitled "Variable Depth Grooved Drill String Member."

In the prior art, a portion of drill pipe consisting of a thicker, more fatigue-resistant material may be used to resist these higher stresses to diminish the tendency of the pipe to fall in the area of securement by slips more often than in other areas of the drill pipe string section. However, the use of the thicker portion of drill pipe section is used to strengthen directly the portion of drill pipe subject to higher stresses, rather than to redistribute part of the stress to stronger areas of the drill pipe string section or to areas more able to absorb or tolerate such stresses.

The present invention addresses some of the deficiencies of the prior art pipe string sections that were more prone to fail in the area of securement by slips more often than in other areas of the pipe, by providing a helical groove machined in the inner or outer surface of the drill pipe string section. Bending and other stresses to which these portions of the pipe sections are subjected are thereby redistributed to and partially absorbed by the portion of the drill pipe string section that contains the helical groove (typically the neck of the tool joint), since the presence of the helical groove makes this portion of the drill pipe string section relatively more resistant to failure due to fatigue, bending, and other stresses by allowing the string section region near the groove to flex more before failure. Further, the helical groove is not in alignment with planes perpendicular to the string section's axis, which tends to reduce the magnitude of the fluctuating stress that occurs when reverse bending stresses are imposed during drilling operations and rotation of the drill pipe. Because of the helical groove, therefore, the portion of the drill pipe string section containing the groove bends more easily than non-grooved portions of the tool joint and pipe section, thereby drawing stress away from these areas and to the grooved region of the drill pipe string section, thus making these other high-stress areas less prone to failure due to fatigue caused by stress. The portion of the string section which contains the groove is correspondingly more able to absorb these redistributed pressures and stresses because of "shock-absorber"-like action of the groove. The helical angle of the groove also tends to reduce fluctuating stresses as discussed hereinabove, since all portions of the groove do not lie on a common circumference of a rotating drill pipe string section. Additionally, the helical groove may be machined into stronger or more resilient portions of the pipe string section, such as the tool joint neck used in the preferred embodiment herein, to redistribute stresses from relatively weaker or more rigid portions of the string section to a stronger and more resilient portion of the string section, which is thus more able to tolerate stresses.

SUMMARY OF THE INVENTION

The present invention provides an apparatus and method for enhancing fatigue and stress resistance properties of a subterranean well drill pipe string section by providing a helical groove near the pipe to tool joint weld. Stresses in and around the top portion of the pipe are redistributed to and absorbed by the helical groove region of the drill pipe string section, which has a relatively greater resistance to fatigue caused by bending and other stresses, thereby making the drill pipe string section less prone to fail due to rotational, tensile, and bending stresses.

The drill pipe string section comprises a tool joint having threads at its first end whereby the drill pipe string section may be secured to the drill pipe string. The tool joint has a neck at its second end, typically of smaller diameter than that of the remainder of the tool joint. The drill pipe string section also has a pipe section connected to the second end of the tool joint, typically by welding. Immediate the area of securement of the tool joint to the pipe section, there may be a "heat effect zone" having relatively lower resistance to stress and fatigue than other portions of the pipe section and tool joint.

Machined into the drill pipe string section immediate the area of weld securement of the tool joint to the pipe section, but away from any heat effect zone, is a helical groove with a varying depth. (In this application, by use of the phrase "varying depth" is meant a groove depth that is unequal at different portions of the groove around the circumference of the drill pipe string section. Likewise, by use of the phrase "constant depth" is meant a groove depth that is equal at all portions of the groove around the circumference of the drill pipe string section). In the preferred embodiment, the helical groove is formed within the outer surface of the neck of the tool joint, although the helical groove may be formed within either the outer or inner surface (or both) of either the tool joint or the first end of the pipe section (or both).

The helical groove is at an angle of between about 10 to about 30 degrees from a plane substantially perpendicular to the drill string section's axis, and, in the preferred embodiment, also has a varying depth which is typically no more than about ⅛ inch, these parameters being more particularly determinable by application according to particular field requirements. The groove may also have a constant depth. (In this application, by the use of the expression "constant depth" is meant a groove depth that is substantially equal at all portions of the groove around the circumference of the drill pipe string section.)

By this arrangement the stresses in the "first end" of the pipe section (that portion being immediate the weld area of securement to the tool joint) are redistributed to and partially absorbed by the portion of the drill pipe string section containing the helical groove, thereby making the drill pipe string section less prone to fall due to rotational, tensile, and bending stresses.

DESCRIPTION OF THE PREFERRED EMBODIMENT

Figure 1:
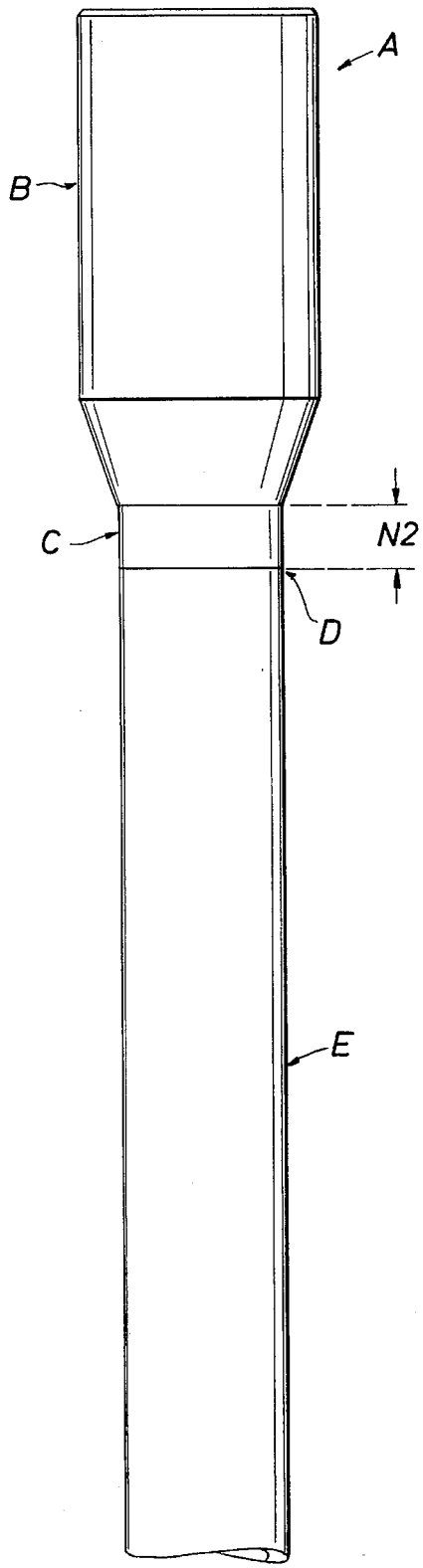
FIG.1 (PRIOR ART)
FIG. 1 is an elevational view of the upper portion of a prior art drill pipe string section.
Figure 2:
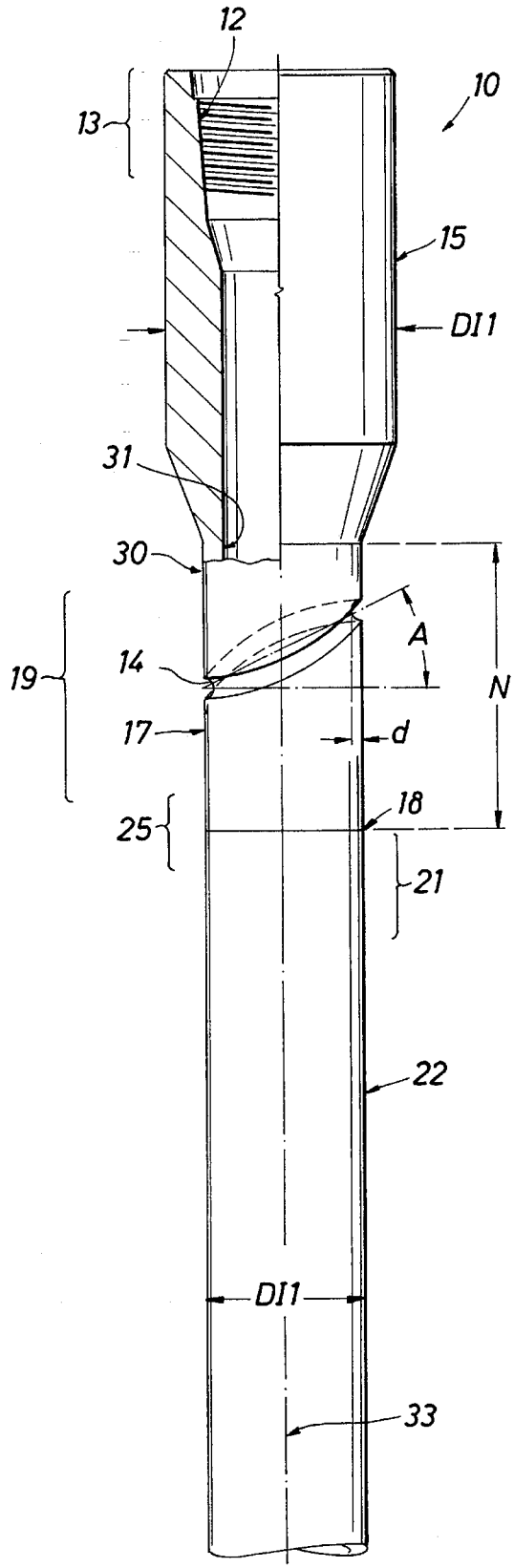
FIG. 2 is an elevational view of the upper portion of a drill pipe string section embodying the invention, a portion being shown in section.

Now referring to FIG. 1, there is shown the significant portions of a typical prior art drill pipe string section A which comprises a tool joint B with a neck C of length N2, and a pipe section E which is welded at weld D to the tool joint B. In FIG. 2, them is shown the significant portions of a drill pipe string section 10 embodying the invention which, as shown, consists of a tool joint 15 and a second tool joint (not shown), and pipe section 22. As can be seen in FIG. 2, the tool joint 15 contains threads 12 at its first end 13 which are used to connect the drill pipe string section 10 to other drill pipe string sections (not shown), which drill pipe string sections together form a drill pipe string. In the preferred embodiment as illustrated in FIG. 2, the tool joint 15 has a neck 17 at its second end 19, typically of smaller diameter DI1 than the diameter DI2 of the remainder of the tool joint 15. The neck 17 in the preferred embodiment, as illustrated in FIG. 2, has a length N that is longer than the length N2 of the neck C of prior art tool joints, as illustrated in FIG. 1, in order to accommodate the helical groove 14 as discussed further below.

The pipe section 22 is secured at its first end 21 to the second end 19 of the tool joint 15 by a weld 18. Immediate the weld 18, there may be a "heat effect zone" 25 in both the second end 19 of the tool joint 15 and in the first end 21 of the pipe section 22, the heat effect zone 25 having relatively lower resistance to stress and fatigue than other portions of the pipe section 22 and tool joint 15.

Machined into the outer surface 30 of the neck 17 of the tool joint 15 is a helical groove 14 with a varying depth. (In this application by use of the phrase "varying depth" is meant a groove depth d that is unequal at different portions of the groove 14 around the circumference of the drill pipe string section 10.) The groove 14 is located above the heat effect zone 25, if one exists.

The helical groove 14 is at an angle A of between 10 to 20 degrees from the plane perpendicular to the drill string section's 10 axis 33, and, in the preferred embodiment, also has a varying depth which is typically no more than ⅛ inch, these parameters being more particularly determinable by experimentation.

By this arrangement the stresses in the pipe section 22 are redistributed to and partially absorbed by the portion of the neck 17 containing the helical groove 14, thereby making the drill pipe string section 10 less prone to fail due to rotational, tensile, and bending stresses.

It will be appreciated by those skilled in the art that, although in the preferred embodiment the helical groove 14 is formed within the outer surface 30 of the neck 17, the helical groove 14 may be formed within either the outer surface 30 or inner surface 31 (or both) of either the tool joint neck 17 or of the first end 21 of the pipe section 22 (or in both the neck 17 and the first end 21 of the pipe section 22, if no heat effect zone 25 exists that prohibits such placement of the helical groove 17). If the groove 14 is formed within the outer surface 30 or inner surface 31 of the first end 21 of the pipe section 22, the groove 14 is located below the heat effect zone 25, if one exists; and, additionally, in such a case the neck 17 need not have a length N longer than the length N2 of the neck C of prior art tool joints.

Further, although in the preferred embodiment the groove 14 has a varying depth, it will be appreciated that the groove 14 may also have a constant depth. (In this application by the use of the expression "constant depth" is meant a groove depth d that is equal at all portions of the groove 14 around the circumference of the drill pipe string section 10.)

Although the invention has been described in terms of specified embodiments that are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A drill pipe string section for enhancing fatigue and stress resistance properties of a subterranean well drill pipe string, comprising:

(a) a tool joint having first and second ends and an axis, said first end of said tool joint having threads whereby said drill pipe string section may be secured to said drill pipe string, said tool joint having a neck portion at its second end, said neck having a length, an outer surface, an inner surface, an inner diameter, an outer diameter, and a wall thickness;

(b) a pipe section having a first end, an inner diameter, an outer diameter, a wall thickness, an axis, an outer surface, an inner surface, and a length, wherein the inner diameter, outer diameter, and wall thickness of said pipe section at its first end are equal to the inner diameter, outer diameter, and wall thickness, respectively, of the second end of said tool joint, further wherein the first end of said pipe section is secured to the second end of said tool joint whereby the axis of said tool joint is also the axis of said pipe section, further wherein the first end of said pipe section and the second end of said tool joint immediate the area of their securement may contain a heat effect zone, said zone having relatively lower resistance to stress and fatigue than other portions of said pipe section and said tool joint, respectively;

(c) wherein said drill pipe string section contains a helical groove having a varying depth and a width immediate the area of securement of the second end of said tool joint to the first end of said pipe section, wherein the depth of said helical groove is at all points substantially less than the wall thickness of the neck of said tool joint and of the wall thickness of said pipe section, further wherein the width of said helical groove is greater than the depth of said helical groove and substantially smaller than the length of said pipe section, further wherein the groove is not located within any said heat effect zone, further wherein said helical groove lies within a plane lying at an angle A degrees from a plane perpendicular to the axis of said tool joint and said pipe section, the stresses in the first end of said pipe section being redistributed to and absorbed by the portion of said drill pipe string section containing said helical groove.

2. The drill pipe string section of claim 1 wherein said helical groove is contained within the neck of said tool joint, the stresses in the first end of said pipe section being redistributed to and absorbed by the portion of the neck of said tool joint containing said helical groove.

3. The drill pipe string section of claim 2 wherein said helical groove is contained within the outer surface of the neck of said tool joint.

4. The drill pipe string section of claim 2 wherein said helical groove is contained within the inner surface of the neck of said tool joint.

5. The drill pipe string section of claim 1 wherein said helical groove is contained within the first end of said pipe section, the stresses in the first end of said pipe section being redistributed to and absorbed by the portion of the first end of said pipe section containing said helical groove.

6. The drill pipe string section of claim 5 wherein said helical groove is contained within the outer surface of the first end of said pipe section.

7. The drill pipe string section of claim 5 wherein said helical groove is contained within the inner surface of the first end of said pipe section.

8. The drill pipe string section of claim 1 wherein said drill pipe string section has an outer surface, further wherein said helical groove is contained within the outer surface of said drill pipe string section.

9. The drill pipe string section of claim 1 wherein said drill pipe string section has an inner surface, further wherein said helical groove is contained within the inner surface of said drill pipe string section.

10. The drill pipe string section of claims 1, 2, 3, 4, 5, 6, 7, 8, or 9, wherein said helical groove has a constant depth.

11. A method for enhancing fatigue and stress resistance properties of a subterranean well drill pipe string having drill pipe string sections, comprising:

(a) providing a tool joint having first and second ends and an axis, said first end of said tool joint having threads whereby said drill pipe string section may be secured to said drill pipe string, said tool joint having a neck portion at its second end, said neck having a length, an outer surface, an inner surface, an inner diameter, an outer diameter, and a wall thickness;

(b) providing a pipe section having a first end, an inner diameter, an outer diameter, a wall thickness, an axis, an outer surface, an inner surface, and a length, wherein the inner diameter, outer diameter, and wall thickness of said pipe section at its first end are equal to the inner diameter, outer diameter, and wall thickness, respectively, of the second end of said tool joint, further wherein the first end of said pipe section is secured to the second end of said tool joint whereby the axis of said tool joint is also the axis of said pipe section, further wherein the first end of said pipe section and the second end of said tool joint immediate the area of their securement may contain a heat effect zone, said zone having relatively lower resistance to stress and fatigue than other portions of said pipe section and said tool joint, respectively; and (c) forming a helical groove in said drill pipe string section, said groove having a varying depth and a width immediate the area of securement of the second end of said tool joint to the first end of said pipe section, wherein the depth of said helical groove is at all points substantially less than the wall thickness of the neck of said tool joint and of the wall thickness of said pipe section, further wherein the width of said helical groove is greater than the depth of said helical groove and substantially smaller than the length of said pipe section, further wherein the groove is not located within any said heat effect zone, further wherein said helical groove lies within a plane lying at an angle A degrees from a plane perpendicular to the axis of said tool joint and said pipe section, the stresses in the first end of said pipe section being redistributed to and absorbed by the portion of said drill pipe string section containing said helical groove.

12. The method of claim 11 wherein said helical groove is formed within the outer surface of the neck of said tool joint, the stresses in the first end of said pipe section being redistributed to and absorbed by the portion of the helical groove in said neck of said tool joint containing said helical groove.

* * * * *